US008372915B2

(12) United States Patent
Ohama et al.

(10) Patent No.: US 8,372,915 B2
(45) **Date of Patent: *Feb. 12, 2013**

(54) GOLF BALL

(75) Inventors: Keiji Ohama, Kobe (JP); Satoko Okabe, Kobe (JP); Kazuya Kamino, Kobe (JP)

(73) Assignee: SRI Sports Limited, Hyogo (JP)

( * ) Notice: Subject to any disclaimer, the term of this patent is extended or adjusted under 35 U.S.C. 154(b) by 671 days.

This patent is subject to a terminal disclaimer.

(21) Appl. No.: 12/574,462

(22) Filed: Oct. 6, 2009

(65) Prior Publication Data

US 2010/0093466 A1 Apr. 15, 2010

(30) Foreign Application Priority Data

Oct. 10, 2008 (JP) ..... 2008-264249

(51) Int. Cl.

| | |
|---|---|
| ***A63B 37/00*** | (2006.01) |
| ***A63B 37/12*** | (2006.01) |
| ***C08L 33/02*** | (2006.01) |
| ***C08L 67/02*** | (2006.01) |
| ***C08L 71/12*** | (2006.01) |
| ***C08L 77/00*** | (2006.01) |

(52) U.S. Cl. ..... 525/133; 525/132; 525/166; 525/175; 525/176; 525/183; 473/373; 473/376

(58) Field of Classification Search ..... None
See application file for complete search history.

(56) References Cited

U.S. PATENT DOCUMENTS

| | | | | |
|---|---|---|---|---|
| 5,047,478 | A | 9/1991 | Ohmae et al. | |
| 5,091,478 | A | 2/1992 | Saltman | |
| 5,176,952 | A | 1/1993 | Joseph et al. | |
| 5,210,138 | A | 5/1993 | Yamamoto et al. | |
| 5,288,242 | A | 2/1994 | Muzslay | |
| 5,587,236 | A | 12/1996 | Agrawal et al. | |
| 5,605,968 | A | 2/1997 | Egashira et al. | |
| 5,656,695 | A | 8/1997 | Endo et al. | |
| 5,713,802 | A | 2/1998 | Moriyama et al. | |
| 5,789,021 | A | 8/1998 | Dooms et al. | |
| 5,820,486 | A | 10/1998 | Tanaka et al. | |
| 5,886,103 | A | 3/1999 | Bellinger et al. | |
| 5,889,114 | A | 3/1999 | Statz | |
| 5,919,862 | A | 7/1999 | Rajagopalan | |
| 5,976,034 | A | 11/1999 | Kato et al. | |
| 6,045,460 | A * | 4/2000 | Hayashi et al. | 473/376 |
| 6,187,864 | B1 | 2/2001 | Rajagopalan | |
| 6,274,669 | B1 | 8/2001 | Rajagopalan | |
| 6,284,840 | B1 | 9/2001 | Rajagopalan et al. | |
| 6,353,058 | B1 | 3/2002 | Rajagopalan | |
| 6,468,169 | B1 * | 10/2002 | Hayashi et al. | 473/371 |
| 6,486,250 | B1 | 11/2002 | Rajagopalan | |
| 6,702,694 | B1 | 3/2004 | Watanabe | |
| 6,762,244 | B2 | 7/2004 | Rajagopalan et al. | |
| 6,800,690 | B2 | 10/2004 | Rajagopalan et al. | |
| 6,966,849 | B2 | 11/2005 | Kato | |
| 7,393,288 | B2 | 7/2008 | Egashira et al. | |
| 7,393,289 | B2 | 7/2008 | Egashira et al. | |
| 2002/0098915 | A1 | 7/2002 | Cavallaro et al. | |
| 2002/0147280 | A1 | 10/2002 | Rajagopalan | |
| 2003/0104879 | A1 | 6/2003 | Iwami | |
| 2004/0029648 | A1 | 2/2004 | Kato | |
| 2004/0116211 | A1 | 6/2004 | Sullivan et al. | |
| 2004/0121856 | A1 | 6/2004 | Iwami | |
| 2004/0142770 | A1 | 7/2004 | Watanabe | |
| 2004/0209708 | A1 | 10/2004 | Bulpett et al. | |
| 2004/0235587 | A1 | 11/2004 | Sullivan et al. | |
| 2006/0063893 | A1 | 3/2006 | Rajagopalan | |
| 2006/0293121 | A1 | 12/2006 | Egashira et al. | |
| 2007/0049419 | A1 | 3/2007 | Egashira et al. | |
| 2007/0281804 | A1 * | 12/2007 | Kamino et al. | 473/376 |

(Continued)

FOREIGN PATENT DOCUMENTS

| | | | |
|---|---|---|---|
| JP | 60-60867 | A | 4/1985 |
| JP | 62-22841 | A | 1/1987 |

(Continued)

OTHER PUBLICATIONS

Dupont product literature for Surlyn 8940.
English translation of Japanese Office Action dated Jan. 17, 2012 for Application No. 2008-335265.
English translation of Japanese Office Action dated Jan. 17, 2012, for Application No. 2008-335261.
English translation of the Japanese Office Action dated Apr. 19, 2011, for Application No. 2008-335261.
English translation of the Japanese Office Action dated Apr. 19, 2011, for Application No. 2008-335262.
English translastion of the Japanese Office Action dated Apr. 19, 2011, for Application No. 2008-335265.

(Continued)

*Primary Examiner* — David Buttner
(74) *Attorney, Agent, or Firm* — Birch, Stewart, Kolasch & Birch, LLP

(57) ABSTRACT

An objective of the present invention is to provide a golf ball striking a balance between the flight distance on the driver shots and the approach performance on the approach shots and having the excellent shot feeling and durability. The present invention provides a golf ball comprising a core consisting of a center and a surrounding layer covering the center; at least one intermediate layer covering the core; and a cover covering the intermediate layer; wherein at least one piece or one layer of the intermediate layer is formed from a highly elastic intermediate layer composition that contains (A) a highly elastic resin having a flexural modulus in a range from 700 MPa to 5,000 MPa and (B) an ionomer resin having a flexural modulus in a range from 150 MPa to 1,000 MPa in a content ratio ((A)/(B)) of (A) the highly elastic resin to (B) the ionomer resin (B) being (20 mass % to 80 mass %)/(80 mass % to 20 mass %) (the total is 100 mass %), and wherein a surface hardness (Hm) of the intermediate layer and a surface hardness (Hs) of the core satisfy the equation: Hm≧Hs, and the cover has a slab hardness (Hc) of 45 or less in Shore D hardness.

19 Claims, 3 Drawing Sheets

U.S. PATENT DOCUMENTS

| | | | | |
|---|---|---|---|---|
| 2008/0227569 | A1 | 9/2008 | Egashira et al. | |
| 2008/0242447 | A1 | 10/2008 | Egashira et al. | |
| 2009/0270203 | A1 | 10/2009 | Okabe | |
| 2009/0280927 | A1 | 11/2009 | Sullivan et al. | |
| 2010/0009776 | A1* | 1/2010 | Okabe et al. | 473/373 |
| 2010/0093466 | A1 | 4/2010 | Ohama et al. | |
| 2010/0167841 | A1* | 7/2010 | Okabe et al. | 473/373 |
| 2010/0167842 | A1 | 7/2010 | Okabe | |
| 2011/0237348 | A1 | 9/2011 | Okabe | |

FOREIGN PATENT DOCUMENTS

| | | | |
|---|---|---|---|
| JP | 63-146928 | A | 6/1988 |
| JP | 2-51544 | A | 2/1990 |
| JP | 3-64343 | A | 3/1991 |
| JP | 6-145486 | A | 5/1994 |
| JP | 9-38238 | A | 2/1997 |
| JP | 9-248351 | A | 9/1997 |
| JP | 10-314341 | A | 12/1998 |
| JP | 10-328326 | A | 12/1998 |
| JP | 2001-509204 | A | 7/2001 |
| JP | 2001-514561 | A | 9/2001 |
| JP | 2003-48286 | A | 2/2003 |
| JP | 2003-504089 | A | 2/2003 |
| JP | 2003-111870 | A | 4/2003 |
| JP | 2003-159351 | A | 6/2003 |
| JP | 2004-59656 | A | 2/2004 |
| JP | 2004-75776 | A | 3/2004 |
| JP | 2004-97802 | A | 4/2004 |
| JP | 2004-130072 | A | 4/2004 |
| JP | 2004-187991 | A | 7/2004 |
| JP | 2004-188207 | A | 7/2004 |
| JP | 2004-305754 | A | 11/2004 |
| JP | 2005-112990 | A | 4/2005 |
| JP | 2007-622 | A | 1/2007 |
| JP | 2007-61605 | A | 3/2007 |
| JP | 2008-69463 | A | 3/2008 |
| JP | 2009-261792 | A | 11/2009 |
| JP | 2010-17414 | A | 1/2010 |
| WO | WO 99/08756 | A1 | 2/1999 |

OTHER PUBLICATIONS

English translation of the Japanese Office Action dated Dec. 27, 2011 for Application No. 2008-264249.

English translation of the Japanese Office Action dated Jan. 17, 2012, for Application No. 2008-335262.

Japanese Office Action with the English translation dated Feb. 21, 2012, for Application No. 2008-117574.

U.S. Office Action dated Nov. 3, 2011, for U.S. Appl. No. 12/498,138.

U.S. Office Action dated Oct. 20, 2011, for U.S. Appl. No. 12/425,746.

English translation of Japanese Office Action dated Mar. 22, 2011, for Application No. 2008-264249.

English translation of the Japanese Office Action dated Jul. 10, 2012, for Japanese Application No. 2009-140164.

English translation of a Japanese Office Action for Japanese Application No. 2008-181892 dated Aug. 28, 2012.

English translation of a Questioning for Japanese Application No. 2008-335265 dated Jul. 30, 2012.

Japanese Office Action with English Translation dated May 15, 2012 for Application No. 2008-117574.

English translation of Japanese Decision of Refusal and Decision to Dismiss an Amendment dated Jun. 12, 2012 for Japanese Application No. 2008-335261.

English translation of Japanese Decision of Refusal and Decision to Dismiss an Amendment dated Jun. 12, 2012 for Japanese Application No. 2008-335262.

Office Action dated Jun. 13, 2012 for U.S. Appl. No. 12/647,127.

Thain, "Science and Golf IV, Proceedings of the World Scientific Congress of Golf," 2002, pp. 319-327.

Office Action for U.S. Appl. No. 12/498,138, dated Apr. 11, 2012.

Office Action for U.S. Appl. No. 12/647,122, dated May 21, 2012.

* cited by examiner

GOLF BALL

FIELD OF THE INVENTION

The present invention relates to a golf ball, in particular, to a technology of striking a balance between the flight distance and approach performance and improving the shot feeling and durability.

DESCRIPTION OF THE RELATED ART

Conventionally, the improvement in the flight distance and the approach performance is required in the development of golf balls. In order to achieve this goal, multi-layered structure of golf ball and new materials have been studied. In recent years, the use of the polyurethane resin for the cover material has improved the approach performance, and the introduction of the multi-layered structure has provided a lowered spin rate on the driver shot, resulting in the improvement in the flight distance.

For example, Japanese Patent No. 3994228 discloses a golf ball having a core and a multi-layered structure cover composed of at least three layers comprising an innermost cover layer covering the core, an intermediate cover layer, and an outermost cover layer. The intermediate cover layer has at least one layer that is harder than the innermost and outermost cover layers and the intermediate cover layer directly covering the innermost cover layer is formed from an ionomer resin and has a Shore D hardness from 61 to 66, and the outermost cover layer has a Shore D hardness less than 55, and the innermost cover layer has a Shore D hardness less than 55.

Japanese Patent Publication No. 2004-130072 A discloses a multi-piece solid golf ball comprising a core consisting of a center, an intermediate layer formed on the center, an outer layer formed on the intermediate layer, and a cover covering the core, wherein the intermediate layer has a surface hardness from 30 to 55 in Shore D hardness, and the outer layer has a hardness from 65 to 85 in Shore D hardness and comprises a thermoplastic resin as a main component. Japanese Patent Publication No. 2004-187991 A discloses a multi-piece solid golf ball comprising a center, an intermediate layer formed on the center, and a cover covering the intermediate layer, wherein the intermediate layer is formed from the only one kind of the material having a bending stiffness from 400 to 5,000 MPa.

Japanese Patent Publication No. 2007-61605 A discloses a golf ball material that essentially contains the following components (I) to (III): (I) an olefin-containing thermoplastic polymer having an acid content of 0.5 mass % or more and less than 5.0 mass %; (II) a resin composition including one or more types selected from a group consisting of diene-based polymers, thermoplastic polymers, and thermosetting polymers; and (III) an oxygen-containing organic metallic compound.

SUMMARY OF THE INVENTION

As described above, although the lowered spin rate on the driver shots has been achieved by the introduction of the multi-piece structure into the golf ball, in order to achieve much lower spin, ionomer resins having an high acid content or high neutralized degree are used as a material for the intermediate layer. However, the use of the ionomer resins having a high acid content causes a problem that the resultant golf ball has a low durability. In addition, the use of the ionomer resins having a high neutralized degree causes a problem that the moldability of the material is lowered.

Therefore, the intermediate layer having a higher stiffness without using these materials has been studied, but materials that satisfy the shot feeling and the durability have not been developed. Further, there is a need for further improvement from the aspect of the flight distance.

The present invention has been made in view of the above situation and an objective of the present invention is to provide a golf ball striking a balance between the flight distance on the driver shots and the approach performance on the approach shots and having the excellent shot feeling and durability.

The present invention that can solve the above problems provides a golf ball comprising:

a core consisting of a center and a surrounding layer covering the center;

at least one intermediate layer covering the core; and a cover covering the intermediate layer, wherein at least one piece or one layer of said intermediate layer is formed from a highly elastic intermediate layer composition that contains (A) a highly elastic resin having a flexural modulus in a range from 700 MPa to 5,000 MPa and (B) an ionomer resin having a flexural modulus in a range from 150 MPa to 1,000 MPa in a content ratio ((A)/(B)) of (A) the highly elastic resin to (B) the ionomer resin (B) being (20 mass % to 80 mass %)/(80 mass % to 20 mass %) (the total is 100 mass %), and wherein a surface hardness Hm of the intermediate layer and a surface hardness Hs of the core satisfy the equation: $Hm \geqq Hs$, and the cover has a slab hardness Hc of 45 or less in Shore D hardness.

The gist of the present invention is the following: the stiffness and repulsion of the intermediate layer are enhanced by using an intermediate layer material containing (A) the highly elastic resin and (B) the ionomer resin, and the core and the intermediate layer are designed to have a structure getting firmer from inside to outside (outer-hard and inner-soft structure) by providing a surrounding layer having a lower hardness than the intermediate layer inside the intermediate layer. Further, the cover has a low hardness by using a relatively soft cover material. As a result, the approach performance is maintained by the low hardness cover and the flight distance is improved by the lowered spin on the driver shots due to the outer-hard inner-soft structure and the high repulsive performance intermediate layer. The shot feeling is also improved by the outer-hard inner-soft structure.

According to the present invention, a golf ball striking a balance between the flight distance and the approach performance and having the excellent shot feeling and durability is obtained.

DESCRIPTION OF THE PREFERRED EMBODIMENT

Figure 1:
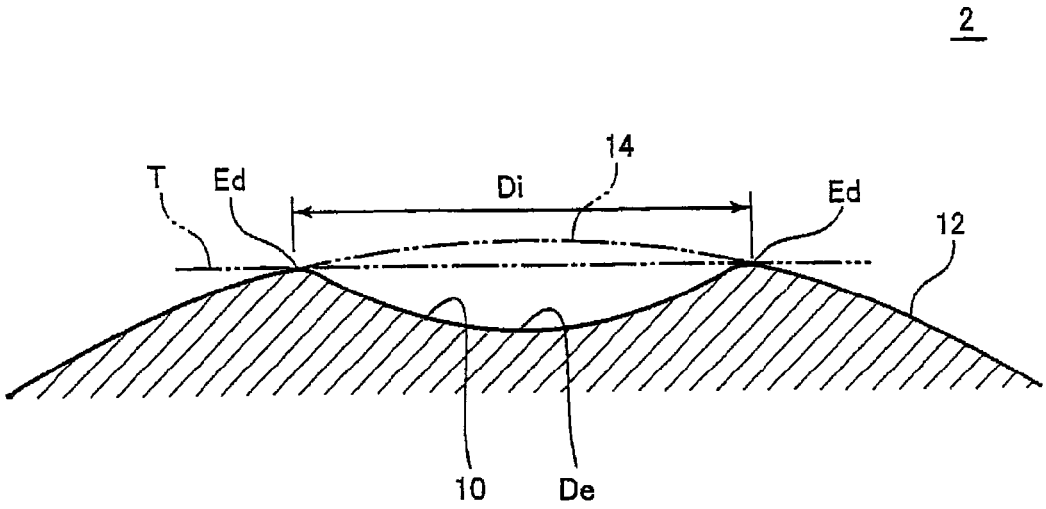
FIG. 1 is an expanded sectional view of the dimples formed on the surface of the golf ball body.

The golf ball of the present invention comprises:

a core consisting of a center and a surrounding layer covering the center;

at least one intermediate layer covering the core; and a cover covering the intermediate layer;

wherein at least one piece or one layer of the intermediate layer is formed from a highly elastic intermediate layer composition that contains (A) a highly elastic resin having a flexural modulus in a range from 700 MPa to 5,000 MPa and (B) an ionomer resin having a flexural modulus in a range from 150 MPa to 1,000 MPa in a content ratio ((A)/(B)) of (A) the highly elastic resin to (B) the ionomer resin (B) being (20 mass % to 80 mass %)/(80 mass % to 20 mass %) (the total is 100 mass %), and wherein a surface hardness Hm of the intermediate layer and a surface hardness Hs of the core satisfy the equation: Hm≧Hs, and the cover has a slab hardness Hc of 45 or less in Shore D hardness. First, the highly elastic intermediate layer composition used in the present invention will be explained.

(A) The highly elastic resin having a flexural modulus in a range from 700 MPa to 5,000 MPa used in the highly elastic intermediate layer composition (hereinafter, may be referred to merely as "(A) highly elastic resin") is not particularly limited, as long as it is a resin having a flexural modulus in a range from 700 MPa to 5,000 MPa, and any of thermoplastic resins and thermosetting resins can be used.

As (A) the highly elastic resin, so-called engineering plastics can be used, and examples include polybutylene terephthalate (PBT), polyphenylene ether (PPE), polyethylene terephthalate (PET), polyethylene (PE), polypropylene (PP), polysulfone (PSF), polyether sulfone (PES), polyphenylene sulfide (PPS), polyarylate (PAR), polyamide-imide (PAI), polyether-imide (PEI), polyether ether ketone (PEEK), polyimide (PI), polytetrafluoroethylene (PTFE), polyamino bismaleimide (PABM), polybisamide triazole, polyphenylene oxide (PPO), polyacetal, polycarbonate, acrylonitrile-butadiene-styrene copolymer (ABS), acrylonitrile-styrene copolymer (AS), and the like. They may be used solely or in combination of two or more types thereof.

Among them, polybutylene terephthalate (PBT), a polymer alloy of polyphenylene ether (PPE) and polyamide (PA) are preferable, and a polymer alloy of polyphenylene ether (PPE) and polyamide 6 or a polymer alloy of polyphenylene ether (PPE) and polyamide 66 is particularly preferable. By using such a polymer alloy, the impact resistance of the intermediate layer and the moldability of the highly elastic intermediate layer composition can be improved more than when an engineering plastic is used solely.

The flexural modulus of (A) the highly elastic resin is 700 MPa or more, preferably 750 MPa or more, and more preferably 800 MPa or more. If the flexural modulus of (A) the highly elastic resin is less than 700 MPa, the stiffness of the intermediate layer is insufficient, and hence the effect of decreasing the spin rate is not obtained. Further, the flexural modulus of (A) the highly elastic resin is 5,000 MPa or less, preferably 4,500 MPa or less, and more preferably 4,000 MPa or less. If the flexural modulus of (A) the highly elastic resin exceeds 5,000 MPa, the stiffness of the intermediate layer is excessively enhanced, and hence the shot feeling and the durability deteriorate. In the present invention, the flexural modulus is a value measured according to ISO 178.

Specific examples of (A) the highly elastic resin include polycarbonates such as "lupilon (registered trademark) S3000, lupilon PM1220", "NOVAREX (registered trademark) 7072A, and NOVAREX 7027A" manufactured by Mitsubishi Engineering-Plastics Company, "Caliver (registered trademark) 301-4" manufactured by Sumitomo Dow Limited, "TAFLON (registered trademark) IR190DH and TAFLON RE2200" manufactured by Idemitsu Kosan Co., Ltd., and the like; modified polyphenylene ethers (PPE) such as "lupiace (registered trademark) AN20", "LEMMALOY (registered trademark) C61HL, LEMMALOY C82HL, LEMMALOY BX505, LEMMALOY BX528A-3, LEMMALOY PX600, LEMMALOY EX700A, and LEMMALOY CX555A" manufactured by Mitsubishi Engineering-Plastics Company, "ZAIRON (registered trademark) 100VV1" manufactured by Asahi Kasei Corporation, "ARTLEX (registered trademark) HT4400 and ARTLEX HT4500" manufactured by Sumitomo Chemical Co., Ltd., and the like; modified polyphenylene oxides (modified PPOs) such as "Noryl (registered trademark) STN15" manufactured by Japan General Electric Company and the like; polyacetals such as "lupital (registered trademark) F10, lupital FU2025, and lupital FU2050" manufactured by Mitsubishi Engineering-Plastics Company, "DURACON (registered trademark) M90-44 and DURACON NT-35" manufactured by Polyplastics Co., Ltd., "Tenac (registered trademark) 4010" manufactured by Asahi Kasei Corporation, and the like; polybutylene terephthalates (PBTs) such as "NOVADURAN (registered trademark) 5505S, NOVADURAN 5503R1, NOVADURAN 5505R1, NOVADURAN 5510R1, and NOVADURAN 5010R8M" manufactured by Mitsubishi Engineering-Plastics Company, "DURANEX (registered trademark) 2002" manufactured by Polyplastics Co., Ltd., "TUFPET (registered trademark) N1003" manufactured by Mitsubishi Rayon Co., Ltd., "Traycon (registered trademark) 5201X10 and Traycon 5201X11" manufactured by Toray Industries Inc., "Crastin (registered trademark) ST820 and Crastin ST830FR" manufactured by E.I. du Pont de Nemours and Company, "Ultradur (registered trademark) KR4071" manufactured by BASF Japan Ltd., "PLANAC (registered trademark) BT-1500" manufactured by DIC Corporation, and the like; and polyolefins such as "NOVATEC XK1159 and NOVATEC XK1181" manufactured by Japan Polychem Corporation, and the like.

The content of (A) the highly elastic resin in the resin component contained in the highly elastic intermediate layer composition is preferably 20 mass % or more, more preferably 25 mass % or more, and even more preferably 30 mass % or more, and is preferably 80 mass % or less, more preferably 75 mass % or less, and even more preferably 70 mass % or less. If the content of (A) the highly elastic resin in the resin component contained in the highly elastic intermediate layer composition is 20 mass % or more, the flexural modulus of the highly elastic intermediate layer composition can be increased to a desired value. As a result, the effect of decreasing the spin rate is obtained, and the flight distance can be improved. On the other hand, if the content of (A) the highly elastic resin in the resin component contained in the highly elastic intermediate layer composition is 80 mass % or less, the flexural modulus of the highly elastic intermediate layer composition is not excessively increased. Thus, the durability and shot feeling of the resultant golf ball become better.

(B) The ionomer resin having a flexural modulus in a range from 150 MPa to 1,000 MPa and contained in the highly elastic intermediate layer composition (hereinafter, may be referred to merely as "(B) ionomer resin") is not particularly limited, as long as it has a flexural modulus in a range from 150 MPa to 1,000 MPa, and examples include an ionomer resin obtained by neutralizing at least a part of carboxyl groups in a binary copolymer of ethylene and an α,β-unsaturated carboxylic acid having 3 to 8 carbon atoms with a metal ion; an ionomer resin obtained by neutralizing at least a part of carboxyl groups in a ternary copolymer of ethylene, an α,β-unsaturated carboxylic acid having 3 to 8 carbon atoms, and an α,β-unsaturated carboxylic acid ester with a metal ion; and a mixture thereof.

As (B) the ionomer resin, one prepared by neutralizing an ethylene-(meth)acrylic acid binary copolymer with a metal ion, one prepared by neutralizing an ethylene-(meth)acrylic acid-(meth)acrylic acid ester ternary copolymer with a metal ion, and a mixture thereof are particularly preferable. In the present invention, a (meth)acrylic acid means acrylic acid, methacrylic acid, or a mixture thereof.

The flexural modulus of (B) the ionomer resin is 150 MPa or more, preferably 180 MPa or more, and more preferably 200 MPa or more, and is 1,000 MPa or less, preferably 800 MPa or less, and more preferably 600 MPa or less. If the flexural modulus of (B) the ionomer resin is less than 150 MPa, the elastic modulus of the intermediate layer becomes low, and the effect of decreasing the spin rate on the driver shot becomes small. On the other hand, if the flexural modulus of (B) the ionomer resin exceeds 1,000 MPa, the elastic modulus of the intermediate layer becomes excessively high, and the durability and the shot feeling of the golf ball deteriorate.

The acid content of (B) the ionomer resin is preferably 5 mass % or more, more preferably 9 mass % or more, and even more preferably 11 mass % or more, and is preferably 30 mass % or less, more preferably 25 mass % or less, and even more preferably 20 mass % or less. By causing the acid content to be 5 mass % or more and 30 mass % or less, desired hardness and stiffness are obtained while the fluidity of the highly elastic intermediate layer composition is maintained. The term "acid content" as used herein refers to as the content of an acidic group-containing component(s) in a resin. The term "acidic group-containing component" as used herein refers to as a monomer component containing an acidic group such as a carboxyl group and the like in a molecule thereof. Examples include a carboxyl group-containing monomer component such as an α,β-unsaturated carboxylic acid and the like.

Examples of a metal (ion) used for neutralization for (B) the ionomer resin include: monovalent metals (ions), such as sodium, potassium, lithium, and the like; divalent metals (ions), such as magnesium, calcium, zinc, barium, cadmium, and the like; trivalent metals (ions), such as aluminum and the like; and other metals (ions), such as tin, zirconium, and the like. Among these metals (ions), sodium, zinc and magnesium (ions) are preferably used because they provide excellent resilience, durability, or the like.

The degree of neutralization of the acidic groups contained in (B) the ionomer resin is preferably 10 mol % or more, more preferably 15 mol % or more, and even more preferably 20 mol % or more, and is preferably 90 mol % or less, more preferably 80 mol % or less, and even more preferably 70 mol % or less. The degree of neutralization of the acidic groups in (B) the ionomer resin can be calculated by using the following mathematical expression 1.

[Mathematical Expression 1]

$$\text{Degree of neutralization (mol \%)} = (\text{the number of moles of acidic groups neutralized in an ionomer resin/the number of moles of all acidic groups contained in the ionomer resin}) \times 100$$

Specific examples of (B) the ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn), and the like)" commercially available from Du Pont-Mitsui Polychemicals Co., Ltd.

Further, ionomer resins commercially available from E.I. du Pont de Nemours and Company include trade name "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li), and the like)", "HPF 1000 (Mg)", and the like.

Further, ionomer resins commercially available from ExxonMobil Chemical Corporation include trade name "Iotek (registered trademark) (e.g. Iotek 8000 (Na), Iotek 8030 (Na), Iotek 7010 (Zn), Iotek 7030 (Zn), and the like)".

It is noted that Na, Zn, Li, and Mg described in the parentheses after the trade names of the ionomer resins indicate metal types of neutralizing metal ions for these ionomer resins.

The content of (B) the ionomer resin in the resin component contained in the highly elastic intermediate layer composition is preferably 20 mass % or more, more preferably 25 mass % or more, even more preferably 30 mass % or more, and is preferably 80 mass % or less, more preferably 75 mass % or less, and even more preferably 70 mass % or less. By causing the content of (B) the ionomer resin in the resin component contained in the highly elastic intermediate layer composition to be 20 mass % or more, the repulsion of the golf ball can be improved. On the other hand, by causing the content of (B) the ionomer resin in the resin component contained in the highly elastic intermediate layer composition to be 80 mass % or less, the elastic modulus of the intermediate layer can be in an appropriate range, and hence the effect of decreasing the spin rate on the driver shot can be enhanced.

The content ratio ((A) the highly elastic resin/(B) the ionomer resin) of (A) the highly elastic resin to (B) the ionomer resin (the total is 100 mass %) in the highly elastic intermediate layer composition is preferably (20 mass % to 80 mass %)/(80 mass % to 20 mass %). By causing the content ratio of (A) the highly elastic resin to (B) the ionomer resin to be in the above range, the intermediate layer has a desired elastic modulus, and the spin rate is decreased on the driver shots, thereby improving the flight distance of the golf ball. The content ratio ((A)/(B)) of (A) the highly elastic resin to (B) the ionomer resin (the total is 100 mass %) in the highly elastic intermediate layer composition is more preferably (25 mass % to 75 mass %)/(75 mass % to 25 mass %) and even more preferably (30 mass % to 70 mass %)/(70 mass % to 30 mass %).

The highly elastic intermediate layer composition may further contain (C) a resin having a polar functional group, in addition to (A) the highly elastic resin and (B) the ionomer resin.

(C) The resin having a polar functional group is a resin obtained by copolymerizing a monomer having a polar functional group and a monomer not having a polar functional group. Herein, the polar functional group is a functional group having a polarity and becomes a factor that allows a resin to possess polarity, and examples include an epoxy group, a hydroxyl group, an amino group, a nitro group, a carboxyl group, a formyl group, a nitrile group, a sulfonic group, and the like.

Because the main backbone of (C) the resin having a functional group has a low polarity, the main backbone is highly compatible with (A) the highly elastic resin. Because the functional group introduced in (C) the resin has a high polarity, the functional group (side chain portion) is highly compatible with (B) the ionomer resin. Thus, by causing the highly elastic intermediate layer composition to contain (C) the resin having a polar functional group, the dispersibility of (A) the highly elastic resin and (B) the ionomer resin can be improved, and hence the durability of the golf ball can be further improved.

Examples of the monomer having a polar functional group include, but are not limited to, epoxy group-containing monomers such as glycidyl (meth)acrylate, 2-vinyloxirane, (allyloxy)oxirane, and the like; hydroxyl group-containing monomers such as 2-hydroxyethyl (meth)acrylate, 2-hydroxypropyl (meth)acrylate, vinyl alcohol, allyl alcohol, 2-hydroxyethyl vinyl ether, and the like; sulfonic group-containing monomers such as vinyl sulfonic acid and the like; and carboxyl group-containing monomers such as (meth)acrylic acid, itaconic acid, maleic anhydride, and the like. These monomers having polar functional groups may be used solely or in combination of two or more thereof. Among them, as the monomer having a polar functional group, epoxy group-containing monomers are preferable, and in particular, glycidyl (meth)acrylate is more preferable. An epoxy group can further improve the interface strength between (A) the highly elastic resin and (B) the ionomer resin because it has reactivity with the carboxyl group contained in (B) the ionomer resin.

Examples of the monomer not having a polar functional group include, but are not limited to, olefins such as ethylene, propylene, 1-butene, isobutene, 1-pentene, and the like; and alkyl (meth)acrylates such as methyl (meth)acrylate, ethyl (meth)acrylate, propyl (meth)acrylate, n-butyl (meth)acrylate, isobutyl (meth)acrylate, and the like. These monomers not having polar functional groups may be used solely or in combination of two or more types thereof. Among them, as the monomer not having a polar functional group, ethylene and methyl (meth) acrylate are preferable.

The content of the monomer component having a polar functional group in (C) the resin having a polar functional group is preferably 0.1 mass % or more, more preferably 0.5 mass % or more, and even more preferably 1 mass % or more, and is preferably 30 mass % or less, more preferably 25 mass % or less, even more preferably 20 mass % or less. By causing the content of the monomer component having a polar functional group in (C) the resin having a polar functional group to be in the above range, the dispersibility of (A) the highly elastic resin and (B) the ionomer resin can be sufficiently enhanced.

Examples of (C) the resin having a polar functional group include a (meth)acrylic acid ester-glycidyl (meth)acrylate copolymer, an epoxy group-containing (meth)acrylic-based polymer, an ethylene-glycidyl (meth)acrylate copolymer, an ethylene-(meth)acrylic acid copolymer, an ethylene-(meth) acrylic acid-(meth)acrylic acid ester copolymer, an ethylene-(meth)acrylic acid ester-glycidyl (meth)acrylate copolymer, a maleic acid modified styrene-ethylene-butylene-styrene block polymer (SEBS), a maleic acid modified styrene-ethylene-butylene-olefin crystalline block polymer (SEBC), maleic acid modified polyethylene (PE), maleic acid modified polypropylene (PP), maleic acid modified ethylene-vinyl acetate copolymer (EVA), a maleic acid modified ethylene-propylene-diene rubber (EPDM), an epoxy group-containing styrene-based polymer, and the like. These (C) resins having polar functional groups may be used solely or in combination of two or more types thereof. Among them, an ethylene-glycidyl (meth)acrylate copolymer, an ethylene-(meth) acrylic acid ester-glycidyl (meth)acrylate copolymer, and a methyl methacrylate-glycidyl methacrylate copolymer are preferable, and in particular, an ethylene-glycidyl methacrylate copolymer or the mixture of an ethylene-glycidyl methacrylate copolymer and another (C) resin having a polar functional group are preferable.

It is noted that as (C) the resin having a polar functional group, an nonionic resin whose polar functional group is not neutralized is preferable, but (C) the resin having a polar functional group may include a so-called ionomer resin obtained by neutralizing a part of polar functional groups in a resin with a metal ion. In this case, an ionomer resin having a flexural modulus of 150 MPa or more is used as (B) the ionomer resin, and an ionomer resin having a flexural modulus less than 150 MPa is used as (C) the resin having a polar functional group.

Specific examples of the resin (C) having a polar functional group include "LOTARDER AX8840" manufactured by Arkema Inc., "ARUFON (registered trademark) UG-4030" manufactured by Toagosei Co., Ltd., "Bond Fast (registered trademark) E" manufactured by Sumitomo Chemical Co., Ltd., "Tuftec (registered trademark) M1913 and Tuftec M1943" manufactured by Asahi Kasei Corporation, "FUSABOND (registered trademark) NM052D" manufactured by E.I. du Pont de Nemours and Company, "Dynaron (registered trademark) 4630P" manufactured by JSR Corporation, "NUCREL (registered trademark) (e.g. NUCREL AN4214C, NUCREL AN4225C, NUCREL AN42115C, NUCREL N0903HC, NUCREL N0908C, NUCREL AN42012C, NUCREL N410, NUCREL N1035, NUCREL N1050H, NUCREL N1108C, NUCREL N1110H, NUCREL N1207C, NUCREL N1214, NUCREL AN4221C, NUCREL N1525, NUCREL N1560, NUCREL N0200H, NUCREL AN4228C, NUCREL N4213C, NUCREL N035C, and the like) manufactured by Du Pont-Mitsui Polychemicals Co., Ltd., and the like.

Further, specific examples of the ionomer resin having a flexural modulus less than 150 MPa and usable as the resin (C) having a polar functional group include "Himilan (registered trademark) 1856 (Na) and Himilan 1855 (Zn)" manufactured by Du Pont-Mitsui Polychemicals Co., Ltd., "Surlyn (registered trademark) 6320 (Mg), Surlyn 8120 (Na), Surlyn 8320 (Na), Surlyn 9320 (Zn), Surlyn 9320W (Zn)" and "HPF 2000 (Mg)" manufactured by E.I. du Pont de Nemours and Company, "Iotek (registered trademark) 7510 (Zn) and Iotek 7520 (Zn)" manufactured by ExxonMobil Chemical Corporation, and the like. It is noted that Na, Zn, and Mg described in the parentheses after the trade names of the ionomer resins indicate metal types of neutralizing metal ions for these ionomer resins.

The content of (C) the resin having a polar functional group in the highly elastic intermediate layer composition is preferably 30 parts or less, more preferably 20 parts or less, even more preferably 15 parts or less, even more preferably 10 parts or less, and is preferably 0.1 part or more, more preferably 2 parts or more with respect to 100 parts of a sum of (A) the highly elastic resin and (B) the ionomer resin by mass. By causing the content of (C) the resin having a polar functional group to be 30 parts by mass or less, the hardness of the intermediate layer does not become excessively hard, and the effect of decreasing the spin rate on the driver shots becomes larger. On the other hand, by causing the content of (C) the resin having a polar functional group to be 0.1 part by mass or more, the compatibility of (A) the highly elastic resin and (B) the ionomer resin can be further enhanced, and thus the durability of the golf ball is further improved.

The highly elastic intermediate layer composition may contain another resin component in addition to (A) the highly elastic resin, (B) the ionomer resin, and (C) the resin having a polar functional group, as long as another resin component does not impair the effects of the present invention. However, it is preferred that the resin component in the highly elastic intermediate layer composition consists of (A) the highly elastic resin, (B) the ionomer resin, and (C) the resin having a polar functional group. Further, a specific gravity adjusting agent such as barium sulfate and the like, an antioxidant a pigment, and the like may be blended with the highly elastic intermediate layer composition, as long as they do not impair the effects of the present invention.

In a process for producing the golf ball of the present invention, (A) the highly elastic resin and (B) the ionomer resin, if necessary, (C) the resin having a polar functional group and an additive, are blended to obtain a highly elastic intermediate layer composition. For this blending of the highly elastic intermediate layer composition, for example, it is preferable to use a mixer capable of blending pellet materials, and it is more preferable to use a tumbler mixer. Embodiments for blending the highly elastic intermediate layer composition include an embodiment in which (A) the highly elastic resin, (B) the ionomer resin, (C) the resin having a polar functional group, and an additive such as titanium oxide and the like are blended and extruded to prepare a pellet; and an embodiment in which an additive such as titanium oxide and the like is blended with (B) the ionomer resin and extruded to prepare a white pellet in advance, and the white pellet, (A) the highly elastic resin, and (C) the pellet of the resin having a polar functional group are dry-blended.

The slab hardness in Shore D hardness of the highly elastic intermediate layer composition is preferably 65 or more, more preferably 67 or more, and even more preferably 69 or more, and is preferably 75 or less, more preferably 74 or less, and even more preferably 73 or less. By causing the slab hardness in Shore D hardness of the highly elastic intermediate layer composition to be 65 or more, the hardness of the resultant intermediate layer increases, and hence the effect of decreasing the spin rate becomes large. Further, by causing the slab hardness in Shore D hardness of the highly elastic intermediate layer composition to be 75 or less, the intermediate layer does not become excessively hard, and hence the durability of the golf ball becomes good.

The flexural modulus of the highly elastic intermediate layer composition is preferably 300 MPa or more, more preferably 320 MPa or more, and even more preferably 350 MPa or more, and is preferably 1,000 MPa or less, more preferably 900 MPa or less, and even more preferably 800 MPa or less. By causing the flexural modulus of the highly elastic intermediate layer composition to be 300 MPa or more, the hardness of the resultant intermediate layer increases, and hence the effect of decreasing the spin rate becomes large. Further, by causing the flexural modulus of the highly elastic intermediate layer composition to be 1,000 MPa or less, the moldability of the highly elastic intermediate layer composition does not deteriorate, the intermediate layer does not become excessively hard, and hence the durability of the golf ball becomes good.

The tensile modulus of the highly elastic intermediate layer composition is preferably 400 MPa or more, more preferably 410 MPa or more, and even more preferably 420 MPa or more, and is preferably 1,500 MPa or less, more preferably 1,400 MPa or less, and even more preferably 1,300 MPa or less. By causing the tensile modulus of the highly elastic intermediate layer composition to be 400 MPa or more, the hardness of the resultant intermediate layer increases, and hence the effect of decreasing the spin rate becomes large. Further, by causing the tensile modulus of the highly elastic intermediate layer composition to be 1,500 MPa or less, the intermediate layer does not become excessively hard, and hence the durability of the golf ball becomes good.

Here, the slab hardness, the flexural modulus, and the tensile modulus of the highly elastic intermediate layer composition are measured by later-described measuring methods. It is noted that the slab hardness, the flexural modulus, and the tensile modulus of the highly elastic intermediate layer composition can be adjusted by appropriately deciding the combination of (A) the highly elastic resin, (B) the ionomer resin, and (C) the resin having a polar functional group, or appropriately deciding the amount of an additive or the like.

Next, the golf ball of the present invention will be described.

The golf ball of the present invention comprises a core consisting of a center and a surrounding layer covering the center;

at least one intermediate layer covering the core; and a cover covering the intermediate layer;

wherein at least one piece or one layer of the intermediate layer is formed from the highly elastic intermediate layer composition described above and a surface hardness Hm of the intermediate layer and a surface hardness Hs of the core satisfy the equation: $Hm \geqq Hs$, and the cover has a slab hardness Hc of 45 or less in Shore D hardness.

The core used in the present invention is preferably a two-layered core consisting of a center and a surrounding layer covering the center.

As the center of the golf ball of the present invention, a conventionally known rubber composition (hereinafter simply referred to as "center rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.1 part by mass or more, more preferably 0.5 part by mass or more, and is preferably 3 parts by mass or less, more preferably 2.8 parts by mass or less, more preferably 2.5 parts by mass or less based on 100 parts by mass of the base rubber. If the amount is less than 0.1 part by mass, the center becomes too soft, and the resilience tends to be lowered, and if the amount is more than 3 parts by mass, the amount of the co-crosslinking agent must be increased in order to obtain an appropriate hardness, which tends to lower the resilience.

The co-crosslinking agent is not particularly limited as long as it has the effect of crosslinking a rubber molecule by graft polymerization with a base rubber molecular chain; for example, $\alpha,\beta$-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, and is preferably 50 parts or less, more preferably 45 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 50 parts by mass, the center becomes too hard, so that the shot feeling may be lowered.

The filler contained in the center rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 0.5 part or more, more preferably 1 part or more, and is preferably 30 parts or less, more preferably 20 parts or less based on 100 parts of the base rubber by mass. If the amount of the filler to be blended is less than 0.5 part by mass, it becomes difficult to adjust the weight, while if it is more than 30 parts by mass, the weight ratio of the rubber component becomes small and the resilience tends to be lowered.

As the center rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis (4-chlorophenyl) disulfide, bis(3-chlorophenyl) disulfide, bis (4-bromophenyl) disulfide, bis(3-bromophenyl) disulfide, bis (4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis (3,5-dibromophenyl) disulfide, bis(2-chloro-5-bromophenyl) disulfide, and bis(2-cyano-5-bromophenyl) disulfide; a tri-substituted diphenyl disulfide such as bis (2,4,6-trichlorophenyl) disulfide, and bis(2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis (2,3,4,5,6-pentachlorophenyl) disulfide and bis(2,3,4,5,6-pentabromophenyl) disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The center can be obtained by mixing, kneading the above mentioned rubber composition and molding the rubber composition in the mold. The conditions for press-molding the center rubber composition should be determined depending on the rubber composition. The press-molding is preferably carried out for 10 to 60 minutes at the temperature of 140° C. to 180° C. under the pressure of 2.9 MPa to 11.8 MPa. Specifically, the press-molding is preferably carried out for 10 to 60 minutes at the temperature of 140° C. to 180° C. Alternatively, the press-molding is preferably carried out in a two-step heating, for example, for 20 to 40 minutes at the temperature of 140° C. to 150° C., and continuously for 5 to 15 minutes at the temperature of 160° C. to 180° C. Next, the surrounding layer constituting the two-layered core will be explained.

Examples of the resin component of the surrounding layer composition for forming the surrounding layer include, in addition to the rubber composition like the center rubber composition, thermoplastic resins such as an ionomer resin having a trade name "Himilan (registered trademark) (e.g. "Himilan 1605" and "Himilan 1706") available from Du Pont-Mitsui Polychemicals Co., Ltd., an ionomer resin having a trade name "Surlyn (registered trademark) (e.g. "Surlyn 8140" and Surlyn "9120") available from E.I. du Pont de Nemours and Company, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A") available from BASF Japan Ltd, a thermoplastic polystyrene elastomer having a trade name "Rabalon (registered trademark)" commercially available from Mitsubishi Chemical Corporation, and the like. These thermoplastic resins and thermoplastic elastomers may be used solely or in combination of two or more types thereof. Among them, since the relatively low hardness and the high rebound property are required for the surrounding layer, the rubber composition like the center rubber composition is preferably used.

The surrounding layer is formed by, for example, covering the center with the surrounding layer composition. Examples of the method for forming the surrounding layer includes, without any limitation, a method which comprises molding the surrounding layer composition into a hemispherical hollow-shell, covering the center with two half hollow-shells and subjecting the center to the press-molding under the condition of 130° C. to 170° C. for 1 to 5 minutes or a method which comprises directly injection-molding the surrounding layer composition onto the center, thereby covering the center with the surrounding layer composition.

The slab hardness of the surrounding layer is preferably 40 or more, more preferably 42 or more, and even more preferably 43 or more, and is preferably 65 or less, more preferably 63 or less, and even more preferably 57 or less in Shore D hardness. If the slab hardness of the surrounding layer is 40 or more in Shore D hardness, the repulsion performance of the resultant golf ball becomes better. On the other hand, if the slab hardness of the surrounding layer is 65 or less in Shore D hardness, the shot feeling of the obtained golf ball becomes better. Herein, the slab hardness of the surrounding layer composition can be adjusted by appropriately selecting the combinations of the resin components and the rubber compositions described above.

In the case that the surrounding layer is formed from the surrounding layer composition comprising the rubber composition as a main component (50 mass % or more), the center preferably has a diameter of 5.0 mm or more, more preferably 10.0 mm or more and preferably has a diameter of 35.0 mm or less, more preferably 30.0 mm or less. If the center has a diameter of 5.0 mm or more, the relatively soft center functions better, especially the spin rate on the W#1 driver shots is decreased. On the other hand, if the center has a diameter of 35.0 mm or less, the thickness of the surrounding layer, intermediate layer and the cover layer does not become excessively thin, and each layer functions well.

When the center has a diameter from 5.0 mm to 35.0 mm, the center preferably has a compression deformation amount (an compression amount of the center in the compression direction thereof) of 4.0 mm or more, more preferably 4.5 mm or more, and preferably has a compression deformation amount of 10.0 mm or less, more preferably 8.0 mm or less, when applying an initial load of 98 N to a final load of 1275 N. If the compression deformation amount is 4.0 mm or more, the shot feeling becomes better, while if the compression deformation amount is 10.0 mm or less, the repulsion becomes better.

In the case that the surrounding layer is formed from the surrounding layer composition comprising the resin composition as a main component (50 mass % or more), the center preferably has a diameter of 31.0 mm or more, more preferably 37.0 mm or more and preferably has a diameter of 41.0 mm or less, more preferably 40.0 mm or less. If the center has a diameter of 31.0 mm or more, the intermediate layer and the cover layer can be made thinner, thus the repulsion of the golf ball is further improved. On the other hand, if the center has a diameter of 41.0 mm or less, the thickness of the intermediate layer and the cover layer does not become excessively thin, and thus the intermediate layer and the cover layer functions well.

When the center has a diameter from 31.0 mm to 41.0 mm, the center preferably has a compression deformation amount (an compression amount of the center in the compression direction thereof) of 2.0 mm or more, more preferably 2.5 mm or more, and preferably has a compression deformation amount of 5.0 mm or less, more preferably 4.0 mm or less, when applying an initial load of 98 N to a final load of 1275 N. If the compression deformation amount is 2.0 mm or more, the shot feeling becomes better, while if the compression deformation amount is 5.0 mm or less, the repulsion becomes better.

In the case of using the surrounding layer composition containing the rubber composition as a main component (50 mass % or more), the surrounding layer preferably has a thickness of 3.0 mm or more, more preferably 5.0 mm or more, even more preferably 7.0 mm or more, and preferably has a thickness of 17.0 mm or less, more preferably 15.0 mm or less, even more preferably 13.0 mm or less. In the case of using the surrounding layer composition containing the resin composition as a main component (50 mass % or more), the surrounding layer preferably has a thickness of 0.2 mm or more, more preferably 0.4 mm or more, even more preferably 0.6 mm or more, and preferably has a thickness of 3.0 mm or less, more preferably 2.5 mm or less, even more preferably 2.0 mm or less. If the thickness of the surrounding layer is not less than the lower limit of the above range, the effect of the surrounding layer becomes large and thus the effect of suppressing the spin rate on the driver shot becomes larger. If the thickness is not more than the upper limit of the above range, the effect of the core becomes large and thus the repulsion becomes better.

The diameter of the core of the golf ball of the present invention is preferably 32.0 mm or more, more preferably 34.0 mm or more, and even more preferably 39.0 mm or more, and is preferably 41.5 mm or less, more preferably 41.0 mm or less, and even more preferably 40.5 mm or less. If the diameter of the core falls within the above range, the effect of suppressing the spin rate on the driver shots is further improved.

When the core has a diameter from 32.0 mm to 41.5 mm, the core preferably has a compression deformation amount (an compression amount of the core in the compression direction thereof) of 2.0 mm or more, more preferably 2.2 mm or more, even more preferably 2.3 mm or more, and preferably has a compression deformation amount of 4.5 mm or less, more preferably 4.0 mm or less, even more preferably 3.5 mm or less, when applying an initial load of 98 N to a final load of 1275 N. If the compression deformation amount is 2.0 mm or more, the effect of suppressing the spin rate on the driver shot and the shot feeling are further improved. On the other hand, if the compression deformation amount is 4.5 mm or less, the repulsion becomes better.

It is preferable that the core of the present invention has a larger surface hardness Hs than the center hardness Ho. The hardness difference (Hs−Ho) between the surface hardness Hs and the center hardness Ho of the core in the golf ball of the present invention is preferably 10 or larger, more preferably 15 or larger, even more preferably 20 or more in Shore D hardness. Making the surface hardness of the core larger than the center hardness increases the launch angle and decreases the spin rate, thereby improving the flight distance of the golf ball. The hardness difference (Hs−Ho) between the surface hardness Hs and the center hardness Ho of the core is, without limitation, preferably 55 or less, more preferably 50 or less, even more preferably 40 or less in Shore D. If the hardness difference is too large, the durability of the golf ball tends to be low.

The center hardness Ho of the core is preferably 20 or larger, more preferably 27 or larger, and even more preferably 32 or larger in Shore D hardness. If the center hardness Ho is 20 or larger in Shore D hardness, the core does not become too soft, resulting in the good repulsion. The center hardness Ho of the core is preferably 60 or smaller, more preferably 53 or smaller, and even more preferably 48 or smaller in Shore D. If the center hardness Ho is 60 or less in Shore D hardness, the core does not become too hard, resulting in the good shot feeling. In the present invention, the center hardness Ho of the core is the hardness measured with the Shore D type spring hardness tester at the central point of a cut plane of a core which has been cut into two halves.

The surface hardness Hs of the core is preferably 45 or larger, more preferably 47 or larger, and even more preferably 48 or larger in Shore D hardness. If the surface hardness Hs is 45 or larger in Shore D hardness, the core does not become too soft, and the good resilience would be obtained. The surface hardness Hs of the core is preferably 65 or smaller, more preferably 63 or smaller, and even more preferably 60 or smaller in shore D hardness. If the surface hardness Hs is 65 or smaller in Shore D hardness, the hardness difference from the intermediate layer can be made large, thus the effect of lowering the spin rate on the driver shots becomes larger.

Next, the intermediate layer covering the two-layered core will be explained.

In the present invention, at least one piece or one layer of the intermediate layer is formed from the highly elastic intermediate layer composition described above and a surface hardness Hm of the intermediate layer and a surface hardness Hs of the core satisfy the equation: $Hm \geqq Hs$.

The intermediate layer is formed by, for example, covering the center with the highly elastic intermediate layer composition. The process for forming the intermediate layer is not particularly limited. For example, the highly elastic intermediate layer composition is molded into hemispherical half shells in advance, and then the center is covered with two half shells and press-molded at the temperature of 130° C. to 170°

C. for 1 to 5 minutes, or the highly elastic intermediate layer composition is injection-molded directly onto the center so as to cover the center.

The thickness of the intermediate layer formed from the highly elastic intermediate layer composition is preferably 0.3 mm or more, more preferably 0.5 mm or more, and even more preferably 0.7 mm or more, and is preferably 3.0 mm or less, more preferably 2.0 mm or less, and even more preferably 1.5 mm or less. By causing the thickness of the intermediate layer formed from the highly elastic intermediate layer composition to be 0.3 mm or more, the effect of the highly elastic intermediate layer becomes large and thus the effect of suppressing the spin rate on the driver shots is further improved. In addition, by causing the thickness of the intermediate layer to be 3.0 mm or less, the lowering of the shot feeling can be suppressed.

The surface hardness Hm of the intermediate layer formed from the highly elastic intermediate layer composition is preferably 65 or more, more preferably 67 or more, even more preferably 69 or more, and is preferably 80 or less, more preferably 78 or less, even more preferably 75 or less in Shore D hardness. If the surface hardness Hm is 65 or more in Shore D hardness, the hardness and stiffness of the intermediate layer is high, and thus the effect of suppressing the spin rate on the driver shots is further improved. If the surface hardness Hm of the intermediate layer is 80 or less in Shore D hardness, the hardness of the intermediate layer does not become excessively high, and thus the durability and the shot feeling of the golf ball are further improved.

The hardness difference between the surface hardness Hm of the intermediate layer and the surface hardness Hs of the core is preferably 3 or more, more preferably 4 or more, even more preferably 5 or more, and is preferably 20 or less, more preferably 18 or less, even more preferably 16 or less in Shore D hardness. If the surface hardness difference (Hm−Hs) falls within the above range, the spin rate becomes lower and the distance is improved.

Embodiments of the core and the intermediate layer include an embodiment where the core is covered with a single-layered intermediate layer, and an embodiment where the core is covered with multi-piece or multi-layered of intermediate layers.

The shape after covering the core with the intermediate layer preferably has a spherical shape. If the intermediate layer does not have a spherical shape, the cover does not have a uniform thickness. As a result, there exist some portions where the performance of the cover is lowered. On the other hand, the core generally has the spherical shape, but the core may be provided with a rib on the surface thereof so that the surface of the spherical core is divided by the ribs. For example, the surface of the spherical core is evenly divided by the ribs. In one embodiment, the ribs are preferably formed on the surface of the spherical core in an integrated manner, and in another embodiment, the ribs are formed as an intermediate layer on the surface of the spherical core.

The ribs are preferably formed along an equatorial line and meridians that evenly divide the surface of the spherical core, if the spherical core is assumed as the earth. For example, if the surface of the spherical core is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to obtain the spherical shape. The shape of the ribs, without limitation, includes an arc or an almost arc (for example, a part of the arc is removed to obtain a flat surface at the cross or orthogonal portions thereof).

When the core is covered with a single-layer intermediate layer or multi-layer of intermediate layers as the intermediate layer, at least one layer of the intermediate layer is formed from the highly elastic intermediate layer composition. When the depressed portion divided by the ribs provided on the surface of the core are filled with a plurality of intermediate layers, at least one piece of the plurality of intermediate layers is formed from the highly elastic intermediate layer composition. It is noted that when the core is covered with multi-piece of or multi-layer of intermediate layers, another intermediate layer which is formed from another intermediate layer composition different from the highly elastic intermediate layer composition may be used, as long as it does not impair the effects of the present invention. In this case, it is preferred that the intermediate layer in contact with the cover is the intermediate layer formed from the highly elastic intermediate layer composition. It is much preferred that all the multi-piece of intermediate layers or multi-layer of intermediate layers are formed from the highly elastic intermediate layer composition.

As the intermediate layer composition other than the highly elastic intermediate layer composition, the same materials described as the surrounding layer composition can be exemplified. The specific gravity adjusting agent such as barium sulfate and tungsten, an anti-oxidant, and a pigment may be blended.

The following will describe the cover of the golf ball of the present invention. Examples of the resin component of the cover composition for forming the cover include, in addition to a polyurethane resin and a known ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polystyrene elastomer having a trade name "Rabalon (registered trademark)(e.g. "Rabalon T3221C")" commercially available from Mitsubishi Chemical Corporation, and the like. These resin components may be used solely or in combination of two or more types thereof. Among them, a polyurethane resin is preferable.

The cover composition for forming the cover of the golf ball of the present invention preferably contains a polyurethane resin as the resin component in an amount of preferably 50 mass % or more, more preferably 60 mass % or more, and even more preferably 70 mass % or more. In a more preferable embodiment, the resin component in the cover composition consists of the polyurethane resin.

The polyurethane resin is not particularly limited, as long as it has a plurality of urethane bonds within the molecule thereof. For example, the polyurethane resin can be obtained by reacting a polyisocyanate component with a high-molecular-weight polyol component to have urethane bonds formed within the molecule thereof. Further, a chain extension reaction with a low-molecular-weight polyol, a low-molecular-weight polyamine, or the like is performed if necessary.

The slab hardness in Shore D hardness of the polyurethane resin is preferably 10 or more, more preferably 20 or more, and even more preferably 30 or more, and is preferably 65 or less, more preferably 60 or less, and even more preferably 55 or less. If the hardness of the polyurethane resin is excessively low, the spin rate on the driver shots may increase. Further, if the hardness of the polyurethane resin is excessively high, the spin rate on the approach shots with an approach wedge may become excessively low. Specific examples of the polyurethane resin include Elastollan (registered trademark) XNY 90A, XNY75A, and ET880 manufactured by BASF Japan Ltd., and the like.

In the present invention, in addition to the aforementioned resin component, the cover may contain a pigment component such as titanium oxide, a blue pigment, a red pigment, and the like, a specific gravity adjusting agent such as zinc oxide, calcium carbonate, barium sulfate, and the like, a dispersant, an antioxidant, an ultraviolet absorber, a light stabilizer, a fluorescent material or a fluorescent brightener, and the like as long as they do not impair the performance of the cover.

The content of the white pigment (titanium oxide), with respect to 100 parts by mass of the resin component for forming the cover, is preferably 0.5 parts by mass or more and more preferably 1 parts by mass or more, and is preferably 10 parts by mass or less and more preferably 8 parts by mass or less. By causing the content of the white pigment to be 0.5 parts by mass or more, it is possible to provide opacity to the cover. If the content of the white pigment is more than 10 parts by mass, there is the possibility that the durability of the resultant cover will deteriorate.

The slab hardness Hc of the cover is preferably 45 or less, more preferably 40 or less, and even more preferably 38 or less in Shore D hardness. If the slab hardness Hc of the cover is 45 or less in Shore D hardness, the spin performance on the approach shots with a short iron or the like is enhanced. As a result, a golf ball with excellent controllability on approach shots is obtained. The slab hardness Hc of the cover is preferably 10 or more, more preferably 15 or more in Shore D hardness. If the slab hardness Hc of the cover is less than 10 in Shore D hardness, the spin rate on the approach shots with a short iron or the like may become too high. Herein, the slab hardness Hc of the cover is a measured hardness of the cover composition that is molded into a sheet form by a measuring method described later.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

When molding a cover, the concave portions called "dimple" are usually formed on the surface. FIG. 1 is an expanded sectional view of a part of a golf ball 2. This figure shows a cross-section which includes the deepest part De of a dimple 10 and the center of the golf ball 2. The up and down direction in FIG. 1 is the depth direction of the dimple 10. The depth direction is the direction from the gravity center of the area of the dimple 10 to the center of the golf ball 2. A chain double-dashed line 14 in FIG. 1 shows a virtual sphere. The surface of the virtual sphere 14 is the surface of the golf ball 2 in the case of assuming that there is no dimple 10. The dimple 10 is depressed in the virtual sphere 14. A land 12 corresponds to the virtual sphere 14.

Two headed arrow Di in FIG. 1 shows the diameter of the dimple 10. The diameter Di is the distance from one contact point Ed to another contact point Ed when a common tangent line T is drawn in both sides of the dimple 10. The contact points Ed are edges of the dimple 10. The edges Ed define the outline of the dimple 10. The diameter Di is preferably 2.0 mm or more and 6.0 mm or less. If the diameter Di is less than the above range, the dimple effect is hardly obtained and if the diameter Di exceeds 6.0 mm, the intrinsic property of the golf ball 2, that is, it is substantially spherical, is lost. The volume of the dimple means the volume of the portion surrounded with the curved plane including the outline of the dimple 10 and the virtual sphere 14. The total volume of the dimples 10 is preferably 250 $mm^3$ or more and 400 $mm^3$ or less. If the total volume is less than 250 $mm^3$, a hopping trajectory may be provided in some cases. If the total volume exceeds 400 $mm^3$, a dropping trajectory may possibly be provided.

In FIG. 1, the distance between the tangent line T and the deepest point De is the depth of the dimple 10. The depth is preferably 0.05 mm or more and 0.60 mm or less. If the depth is less than 0.05 mm, a hopping trajectory may be provided in some cases. On the other hand, if the depth exceeds 0.60 mm, a dropping trajectory may possibly be provided.

The total number of the dimples 10 formed on the cover is preferably 200 or more and 500 or less. If the total number is less than 200, the dimple effect is hardly obtained. On the other hand, if the total number exceeds 500, the dimple effect is hardly obtained because the size of the respective dimples 10 is small. The shape (shape in a plan view) of dimples 10 includes, for example, without limitation, a circle, polygonal shapes such as roughly triangular shape, roughly quadrangular shape, roughly pentagonal shape, and roughly hexagonal shape, another irregular shape. The shape of the dimples is employed solely or in combination at least two of them.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 23 μm or smaller. This is because if the thickness is smaller than 5 μm, the paint film is easy to wear off due to continued use of the golf ball, and if the thickness is larger than 25 μm, the effect of the dimples is reduced, resulting in deteriorating flying performance of the golf ball.

In the present invention, the thickness of the cover of the golf ball is preferably 0.8 mm or less, more preferably 0.6 mm or less, even more preferably 0.5 mm or less, even more preferably 0.4 mm or less. If the cover has a thickness of 0.8 mm or less, the effect of suppressing the spin rate on the driver shot and the shot feeling are further improved. The thickness of the cover is preferably 0.1 mm or more, more preferably 0.15 mm or more. If the thickness is 0.1 mm or more, the spin performance on the approach shots becomes better.

Herein, the thickness is measured at the portion where the dimples are not formed, that is the thickness under the land 12 (refer to FIG. 1), and the thicknesses measured at least 4 portions are averaged.

The golf ball of the present invention is not limited, as long as it comprises a core consisting of a center and a surrounding layer covering the center; at least one intermediate layer covering the core; and a cover covering the intermediate layer. Specific examples of the golf ball of the present invention include a four-piece golf ball comprising a core consisting of a center and a surrounding layer covering the center, an intermediate layer covering the core, and a cover covering the intermediate layer; and a multi-piece golf ball comprising a core consisting of a center and a surrounding layer covering the center, a multi-piece of or multi-layer of intermediate layers covering the core and a cover covering the intermediate layer. Among them, the present invention is suitably applicable to the four-piece golf ball comprising a core consisting of a center and a surrounding layer covering the center, an intermediate layer covering the core and a cover covering the intermediate layer.

When the golf ball of the present invention has a diameter in a range from 40 mm to 45 mm, a compression deformation amount of the golf ball (deformation amount of the golf ball in the compression direction thereof) when applying an initial load of 98 N to a final load of 1275 N to the golf ball is preferably 2.0 mm or more, more preferably 2.1 mm or more, and even more preferably 2.2 mm or more, and is preferably 3.0 mm or less, more preferably 2.9 mm or less, and even more preferably 2.8 mm or less. By causing the compression deformation amount to be 2.0 mm or more, desirable shot feeling is obtained. By causing the compression deformation amount to be 3.0 mm or less, desirable resilience is obtained.

EXAMPLES

Hereinafter, the present invention will be described in detail by way of example. The present invention is not limited to examples described below. Various changes and modifications can be made without departing from the spirit and scope of the present invention.

(1) Slab Hardness (Shore D Hardness)

Sheets with a thickness of about 2 mm were produced using a surrounding layer composition, a highly elastic intermediate layer composition, or a cover composition, and stored at 23° C. for two weeks. Three or more of these sheets were stacked on one another so as not to be affected by the measuring base on which the sheets were placed, and the stack was measured with a type P1 auto loading durometer manufactured by Kobunshi Keiki Co., Ltd., provided with a Shore D type spring hardness tester prescribed in ASTM-D2240 standard. Herein, the sheets were produced by injection molding in the case of the surrounding layer composition comprising a resin composition as a main component, the highly elastic intermediate layer composition and the cover composition. In the case of the surrounding layer composition comprising the rubber composition as a main component, the sheets were produced by hot pressing under the conditions of 140° C. to 180° C. for 10 minutes to 60 minutes.

(2) Flexural Modulus (MPa)

A test sheet with a length of 80.0±2 mm, a width of 10.0±0.2 mm, and a thickness of 4.0±0.2 mm was produced by injection molding using a highly elastic intermediate layer composition, and stored at 23° C. for two weeks. The flexural modulus of this sheet was measured according to ISO178. The measurement was conducted at a temperature of 23° C. and a humidity of 50% RH.

(3) Tensile Modulus (MPa)

A sheet with a thickness of about 2 mm was produced by injection molding using a highly elastic intermediate layer composition, and stored at 23° C. for two weeks. A dumbbell-shaped test piece was produced from this sheet, and the tensile modulus of the test piece was measured according to ISO 527-1.

(4) Surface Hardness of Core and Intermediate Layer (Shore D Hardness)

A type P1 auto loading durometer manufactured by Kobunshi Keiki Co., Ltd., provided with a Shore D type spring hardness tester prescribed in ASTM-D2240 standard was used. The surface hardness Hs of the core and the surface hardness Hm of the intermediate layer are determined by measuring the Shore D hardness at the surface portions of the core and the intermediate layer, respectively.

(5) Compression Deformation Amount (mm)

A compression deformation amount of the center, the core, or the golf ball (an deformation amount in the compression direction thereof), when applying an initial load of 98 N to a final load of 1275 N to the center, the core or the golf ball, was measured.

(6) Shot with Driver

A metal-headed W#1 driver (XXIO, S shaft, loft: 11°, manufactured by SRI Sports Limited) was installed on a swing robot M/C manufactured by Golf Laboratories, Inc. Golf balls were hit at the head speed of 50 m/sec, and the flight distances (the distance from the launch point to the stop point) were measured. This measurement was conducted twelve times for each golf ball, and the average value was used as the measurement value for each golf ball.

(7) Shot with Short Iron

A sand wedge was installed on a swing robot M/C manufactured by Golf Laboratories, Inc. Golf balls were hit at the head speed of 21 m/sec. The measurement was conducted twelve times for each golf ball, and the average value was used as the spin rate. A sequence of photographs of the golf ball hit were taken to measure the spin rate right after hitting the golf ball.

(8) Shot Feeling

The golf balls were actually hit with an approach club (sand wedge) by ten amateur golfers (high skilled golfers). The shot feelings were ranked into the following criteria, based on the number of the golfers who answered "The impact of the shots is small and resilient and the shot feeling is good."

A: 8 or more golfers

B: 6 to 7 golfers

C: 4 to 5 golfers

D: 3 or less golfers

The results are shown in Tables No. 10 to No. 12.

(9) Durability

A metal-headed W#1 driver (XXIO S shaft, loft: 11°, manufactured by SRI Sports Limited) was installed on a swing robot M/C manufactured by Golf Laboratories, Inc. Each golf ball was hit at a head speed of 45 m/sec. This procedure was repeated, and the number of hits required to break the golf ball was counted. It is noted that there was a case where the golf ball looks unbroken but a crack occurs in the intermediate layer. In such a case, whether or not the golf ball was broken was determined based on deformation of the golf ball and difference in sound at hitting of the golf ball. The number of hits for golf ball No. 9 was defined as an index of 100, and the durability of each golf ball was represented by converting the number of hits for each golf ball into this index. A greater index value indicates that the durability of the golf ball is excellent.

[Production of Golf Balls]

(1) Production of Center

Centers were obtained by kneading rubber compositions having the formulation shown in Table 1, and heat-pressing the kneaded material in upper and lower molds, each having a hemispherical cavity, at 170° C. for 30 minutes.

TABLE 1

| Center Composition No. | | 1 | 2 | 3 |
|---|---|---|---|---|
| Formulation | Polybutadiene | 100 | 100 | 100 |
| | Zinc acrylate | 20 | 36 | 40 |
| | Zinc oxide | 10 | 10 | 10 |
| | Barium sulfate | Appropriate Amount*) | Appropriate Amount*) | Appropriate Amount*) |
| | Diphenyl disulfide | 0.5 | 0.5 | 0.5 |
| | Dicumyl peroxide | 0.8 | 0.8 | 0.8 |

Formulation: parts by mass

*)The amount of Barium sulfate was adjusted such that the golf ball had a mass of 45.4 g.

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

It is noted that an appropriate amount of barium sulfate was added such that the obtained golf ball had a mass of 45.4 g.

(2) Preparation of the Surrounding Layer Composition

Blending materials shown in table 2 were mixed with an twin-screw extruder to obtain the surrounding layer compositions No. b, and No. c in the pellet form. The extruding conditions were a screw diameter of 45 mm, a screw rotational speed of 200 rpm, and screw L/D=35, and the mixtures were heated to 160 to 230° C. at the die position of the extruder.

TABLE 2

| Surrounding layer Composition No. | | a | b | c |
|---|---|---|---|---|
| Formulation (Parts) | Polybutadiene | 100 | — | — |
| | Zinc acrylate | 38 | — | — |
| | Zinc oxide | 5 | — | — |
| | Barium sulfate | 5 | — | — |
| | Diphenyl disulfide | 0.5 | — | — |
| | Dicumyl peroxide | 0.8 | — | — |
| | Himilan 1605 | — | 40 | — |
| | Himilan 1706 | — | 40 | — |
| | Surlyn 8140 | — | — | 50 |

TABLE 2-continued

| Surrounding layer Composition No. | a | b | c |
|---|---|---|---|
| Surlyn 9120 | — | — | 50 |
| Rabalon T3221C | — | 20 | — |
| Slab hardness (Shore D) | 56 | 55 | 69 |

Formulation: parts by mass

Notes on table 2

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

Himilan 1605: Sodium ion neutralized ethylene-methacrylic acid copolymer ionomer resin available from Du Pont-Mitsui Polychemicals Co., Ltd Himilan 1706: Zinc ion neutralized ethylene-methacrylic acid copolymer ionomer resin available from Du Pont-Mitsui Polychemicals Co., Ltd SURLYN 8140: a sodium ion neutralized ethylene-methacrylic acid copolymer ionomer resin available from E. I. du Pont de Nemours and Company.

SURLYN 9120: a zinc ion neutralized ethylene-methacrylic acid copolymer ionomer resin available from E. I. du Pont de Nemours and Company.

Rabalon T3221C: Polystyrene elastomer available from Mitsubishi Chemical Corporation.

(3) Preparation of Cover Composition and Highly Elastic Intermediate Layer Composition Blending materials shown in Tables 3, and 5 to 7 were mixed with a twin-screw kneading extruder to prepare cover compositions in the pellet form and highly elastic intermediate layer compositions in the pellet form, respectively. The extruding conditions were a screw diameter of 45 mm, a screw rotational speed of 200 rpm, and screw L/D=35, and the mixtures were heated to 160 to 230° C. at the die position of the extruder.

TABLE 3

| Cover composition No. | X | Y | Z | W |
|---|---|---|---|---|
| Elastollan XNY85A | 100 | — | 20 | — |
| Elastollan XNY97A | — | 100 | 80 | — |
| Elastollan XNY80A | — | — | — | 100 |
| Titanium oxide | 4 | 4 | 4 | 4 |
| Slab hardness(Shore D) | 32 | 47 | 44 | 27 |

Formulation: parts by mass

Elastollan XNY85A: a thermoplastic polyurethane elastomer manufactured by BASF Japan Ltd.(Shore D: 32)

Elastollan XNY97A: a thermoplastic polyurethane elastomer manufactured by BASF Japan Ltd.(Shore D: 47)

Elastollan XNY80A: a thermoplastic polyurethane elastomer manufactured by BASF Japan Ltd.(Shore D: 27)

(4) Production of Golf Ball Body

The centers obtained above were covered with the surrounding layer composition to form the surrounding layer and obtain spherical cores. In the case of using the surrounding layer compositions No. b and No. c, the surrounding layer was formed by directly injection-molding the surrounding layer compositions onto the center. In the case of using the surrounding layer composition No. a, first the surrounding layer composition shown in Table 2 was kneaded and the upper die for molding a center in the state that the center was set therein and a lower die for molding a core were clamped in a manner that a necessary amount of the surrounding layer composition was brought into contact with a half of the surface of the center and heat pressing was carried out to produce an intermediate core molded product having an surrounding layer formed on a half of the surface of the center. Next, the lower die for molding the core in the state that the surrounding layer of the intermediate core molded product was housed and an upper die for molding a core were clamped in a manner that a necessary amount of the surrounding layer composition was brought into contact with the other half of the surface of the center and heat pressing was carried out to produce a core having a surrounding layer on the other half of the surface of the center.

The intermediate layer compositions obtained above were injection-molded onto the spherical cores to form the intermediate layers covering the cores. Subsequently, golf balls were produced by injection molding or compression molding. In the injection molding method, the cover composition was directly injection-molded onto the intermediate layer to form a cover. In the compression molding, the cover composition was molded into half hells by injection-molding or compression-molding, and the core formed with the intermediate layer was covered with the two half shells and then subjected to the heat-pressing. Upper and lower molds have a spherical cavity with pimples, a part of which serves as a hold pin which is extendable and retractable. The hold pins were protruded to hold the core, the resin heated to 210° C. was charged into the mold under a pressure of 80 tons within 0.3 seconds, and cooled for 30 seconds. Then, the mold was opened, and the golf ball body were taken out from the mold.

The surface of the obtained golf ball body were treated with sandblast, marked, and painted with a clear paint. The paint was dried in an oven at 40° C. for 4 hours, and golf balls having a diameter of 42.7 mm and a mass of 45.4 g were obtained.

Figure 2:
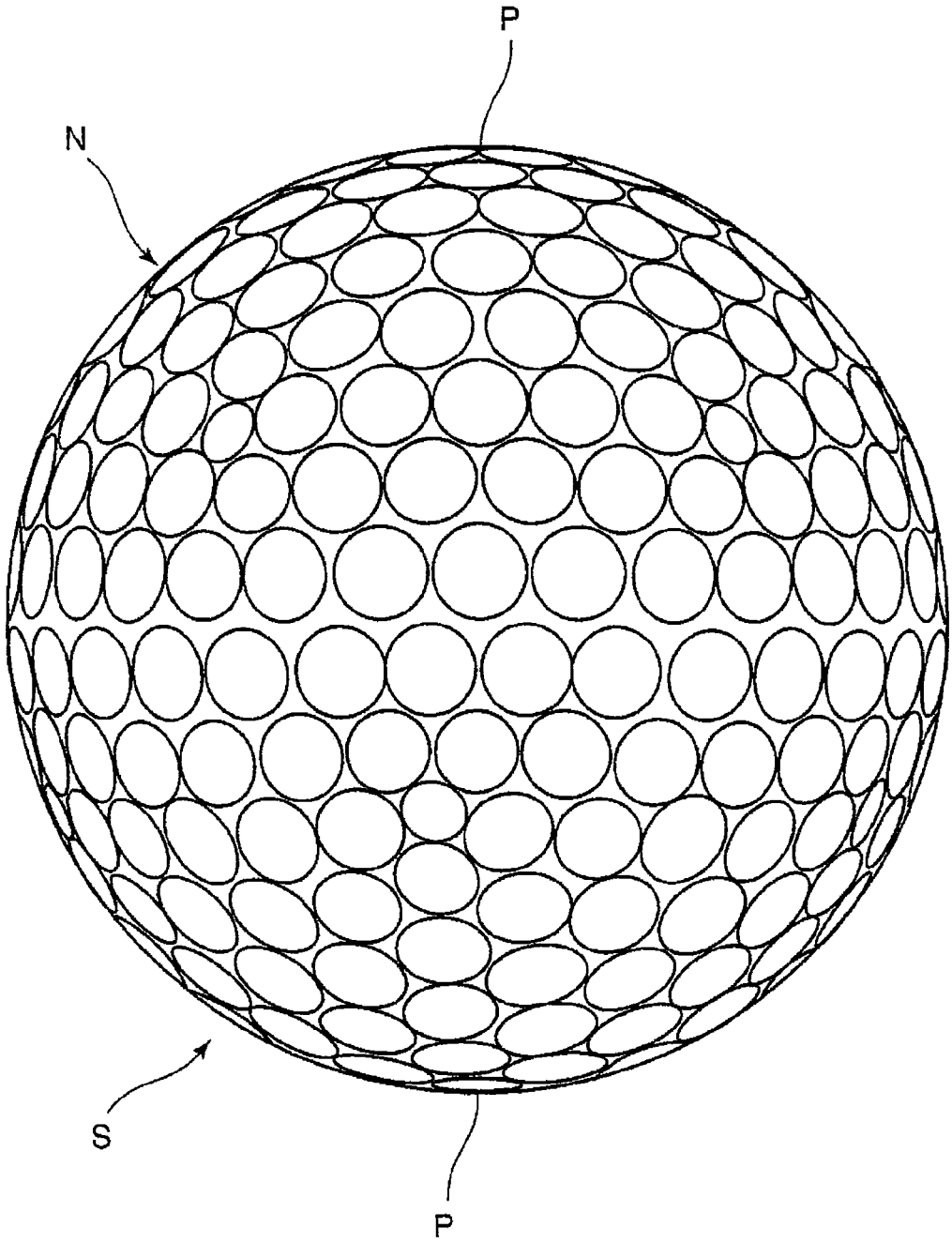
FIG. 2 is a front view of the dimple pattern formed on the surface of the golf ball.
Figure 3:
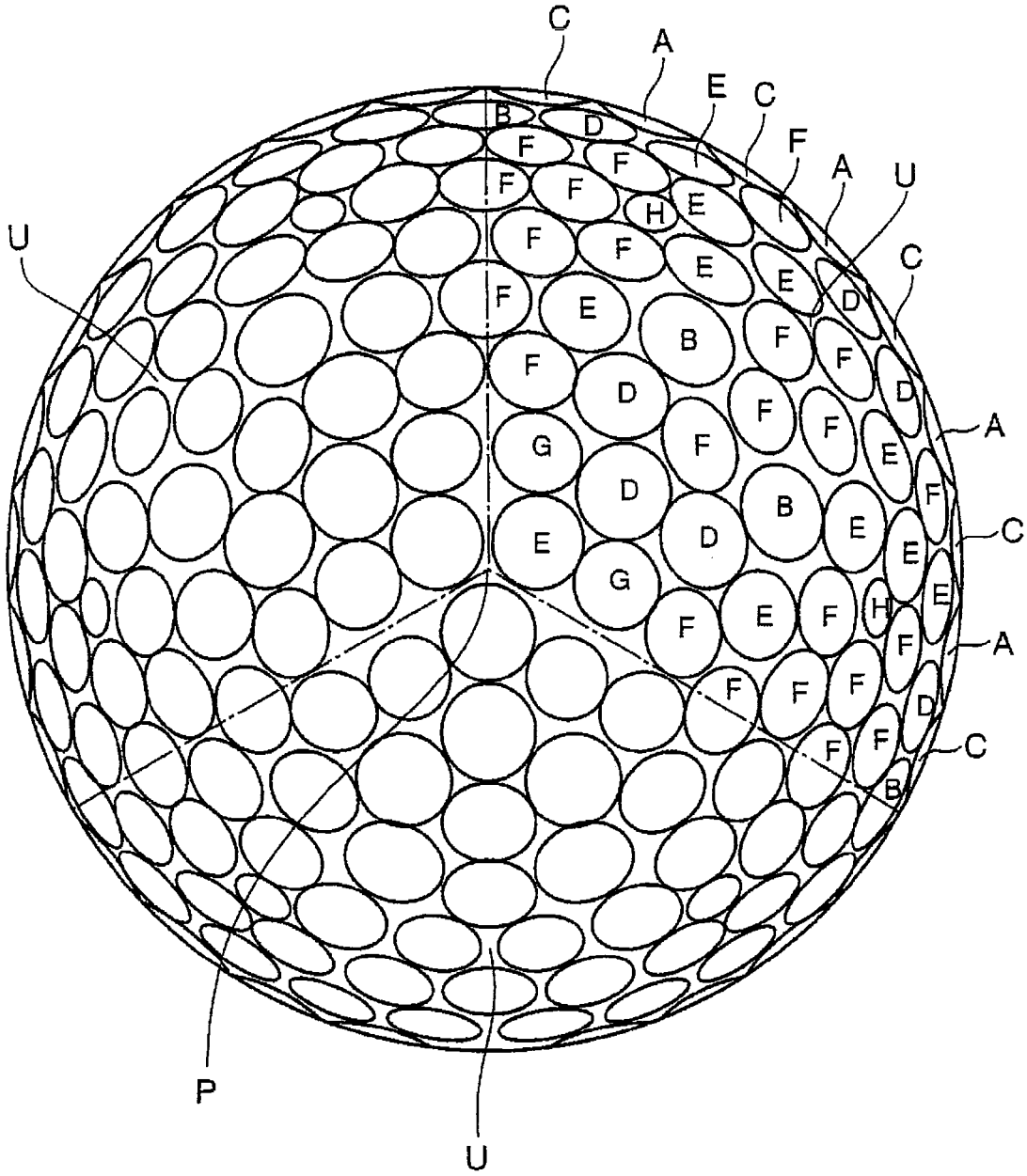
FIG. 3 is a top plan view of the dimple pattern formed on the surface of the golf ball.

The dimple patterns shown in table 4 and FIG. 2 and FIG. 3 were formed on the surface of the golf ball. In the north hemisphere N and south hemisphere S of the golf ball, there is a unit U which has rotational symmetries through 120 degrees. In each of the north hemisphere N and the south hemisphere S, there are three units U. FIG. 3 shows kinds of dimples by represented symbols A to H in one unit U. In table 4, "diameter" of the dimple is depicted by Di in FIG. 1 and "depth" means a distance between the tangential line T and the deepest portion De. P means Pole in FIG. 3.

TABLE 4

| Kinds | Number | Diameter (mm) | Depth (mm) | Curvature radius (mm) | Volume ($mm^3$) | Front view | Plan view |
|---|---|---|---|---|---|---|---|
| A | 24 | 4.75 | 0.140 | 20.22 | 1.242 | FIG. 2 | FIG. 3 |
| B | 18 | 4.65 | 0.140 | 19.38 | 1.190 | | |
| C | 30 | 4.55 | 0.135 | 19.24 | 1.099 | | |
| D | 42 | 4.45 | 0.135 | 18.40 | 1.051 | | |
| E | 66 | 4.25 | 0.135 | 16.79 | 0.959 | | |
| F | 126 | 4.05 | 0.130 | 15.84 | 0.839 | | |
| G | 12 | 3.95 | 0.130 | 15.07 | 0.798 | | |
| H | 12 | 2.80 | 0.120 | 8.23 | 0.370 | | |

The golf balls were evaluated with respect to the durability, compression deformation amount, and the flight distance. The results of evaluations were also shown in tables 5 to 7.

TABLE 5

| Golf ball No. | | | 1 | 2 | 3 | 4 | 5 |
|---|---|---|---|---|---|---|---|
| Core | Center composition No. | | 1 | 1 | 2 | 1 | 2 |
| | Center Diameter (mm) | | 20.1 | 20.1 | 37.7 | 20.1 | 37.7 |
| | Compression deformation amount (mm) | | 5.8 | 5.8 | 3.1 | 5.8 | 3.1 |
| | Surrounding layer composition No. | | a | a | b | a | b |
| | Surrounding layer thickness (mm) | | 9.8 | 9.8 | 1.0 | 9.8 | 1.0 |
| | Core center hardness Ho (Shore D) | | 30 | 30 | 43 | 30 | 43 |
| | Core surface hardness Hs (Shore D) | | 62 | 62 | 58 | 62 | 58 |
| Intermediate layer composition | Formulation (parts) | (B) SURLYN 8945 | 40 | 40 | 40 | 30 | 40 |
| | | HIMILAN AM7329 | 40 | 40 | 40 | 30 | 40 |
| | | (A) LEMMALOY BX505 | 20 | 20 | — | 40 | 20 |
| | | LEMAMLOY C82HL | — | — | 20 | — | — |
| | | (C) LOTADER AX8840 | 5 | 5 | 5 | 5 | — |
| | | PRIMALLOY B1980N | — | — | — | — | — |
| | | Titanium oxide | 4 | 4 | 4 | 4 | 4 |
| | Properties | Slab hardness (Shore D) | 66 | 66 | 66 | 70 | 67 |
| | | Flexural modulus (MPa) | 300 | 300 | 434 | 488 | 320 |
| | | Tensile modulus (MPa) | 440 | 440 | 480 | 498 | 425 |
| | Intermediate layer thickness (mm) | | 1.0 | 1.0 | 1.0 | 1.0 | 1.0 |
| | Surface hardness Hm (Shore D) | | 68 | 68 | 68 | 72 | 69 |
| Cover | Cover composition No. | | W | X | X | X | X |
| | Thickness (mm) | | 0.5 | 0.5 | 0.5 | 0.5 | 0.5 |
| | Cover slab hardness Hc (Shore D) | | 27 | 32 | 32 | 32 | 32 |
| | Molding method | | Comp. | Comp. | Comp. | Comp. | Comp. |
| Golf ball evaluation | Compression deformation amount (mm) | | 2.45 | 2.4 | 2.35 | 2.3 | 2.35 |
| | Flight distance on driver shot (m) | | 247.0 | 248.5 | 248.0 | 249.5 | 248.5 |
| | Spin rate on driver shot (rpm) | | 2550 | 2460 | 2500 | 2420 | 2480 |
| | Spin rate on short iron shot (rpm) | | 6820 | 6515 | 6530 | 6480 | 6519 |
| | Shot feeling | | E | E | E | G | E |
| | Durability | | 140 | 125 | 120 | 110 | 110 |

TABLE 6

| | Golf ball No. | | 6 | 7 | 8 | 9 | 10 |
|---|---|---|---|---|---|---|---|
| Core | Center composition No. | | 1 | 2 | 1 | 1 | 1 |
| | Center Diameter (mm) | | 20.1 | 38.1 | 20.1 | 20.1 | 20.1 |
| | Compression deformation amount (mm) | | 5.8 | 3.1 | 5.8 | 5.8 | 5.8 |
| | Surrounding layer composition No. | | a | c | a | a | a |
| | Surrounding layer thickness (mm) | | 9.8 | 1.0 | 9.9 | 9.8 | 9.8 |
| | Core center hardness Ho (Shore D) | | 30 | 43 | 30 | 30 | 30 |
| | Core surface hardness Hs (Shore D) | | 62 | 70 | 62 | 62 | 62 |
| Intermediate layer composition | Formulation (parts) | (B) SURLYN 8945 | 40 | 30 | 40 | 50 | — |
| | | HIMILAN AM7329 | 40 | 30 | 40 | 50 | — |
| | | (A) LEMMALOY BX505 | 20 | 40 | 20 | — | — |
| | | LEMAMLOY C82HL | — | — | — | — | — |
| | | (C) LOTADER AX8840 | 5 | 5 | 5 | — | — |
| | | PRIMALLOY B1980N | — | — | — | — | 100 |
| | | Titanium oxide | 4 | 4 | 4 | 4 | 4 |
| | Properties | Slab hardness (Shore D) | 66 | 70 | 66 | 65 | 78 |
| | | Flexural modulus (MPa) | 300 | 488 | 300 | 282 | 845 |
| | | Tensile modulus (MPa) | 440 | 498 | 440 | 375 | 890 |
| | Intermediate layer thickness (mm) | | 1.0 | 0.8 | 1.0 | 1.0 | 1.0 |
| | Surface hardness Hm (Shore D) | | 68 | 70 | 68 | 65 | 80 |
| Cover | Cover composition No. | | Z | X | W | X | X |
| | Thickness (mm) | | 0.5 | 0.5 | 0.4 | 0.5 | 0.5 |
| | Cover slab hardness Hc (Shore D) | | 44 | 32 | 27 | 32 | 32 |
| | Molding method | | Comp. | Comp. | Comp. | Comp. | Comp. |
| Golf ball evaluation | Compression deformation amount (mm) | | 2.35 | 2.2 | 2.45 | 2.4 | 2.2 |
| | Flight distance on driver shot (m) | | 251.0 | 248.0 | 247.5 | 246.0 | NG |
| | Spin rate on driver shot (rpm) | | 2290 | 2520 | 2510 | 2610 | |
| | Spin rate on short iron shot (rpm) | | 6380 | 6450 | 6750 | 6551 | |
| | Shot feeling | | G | G | E | E | |
| | Durability | | 105 | 115 | 175 | 100 | |

TABLE 7

| | Golf ball No. | | 11 | 12 | 13 | 14 | 15 |
|---|---|---|---|---|---|---|---|
| Core | Center composition No. | | 2 | 1 | 1 | 3 | 2 |
| | Center Diameter (mm) | | 37.7 | 20.1 | 20.1 | 39.7 | 37.7 |
| | Compression deformation amount (mm) | | 3.1 | 5.8 | 5.8 | 2.7 | 3.1 |
| | Surrounding layer composition No. | | b | a | a | — | c |
| | Surrounding layer thickness (mm) | | 1.0 | 9.8 | 9.8 | — | 1.0 |
| | Core center hardness Ho (Shore D) | | 43 | 30 | 30 | 50 | 43 |
| | Core surface hardness Hs (Shore D) | | 58 | 62 | 62 | — | 70 |
| Intermediate layer composition | Formulation (parts) | (B) SURLYN 8945 | 5 | 45 | 40 | 40 | 40 |
| | | HIMILAN AM7329 | 5 | 45 | 40 | 40 | 40 |
| | | (A) LEMMALOY BX505 | 90 | 10 | 20 | 20 | — |
| | | LEMAMLOY C82HL | — | — | — | — | 20 |
| | | (C) LOTADER AX8840 | 5 | 5 | 5 | 5 | 5 |
| | | PRIMALLOY B1980N | — | — | — | — | — |
| | | Titanium oxide | 4 | 4 | 4 | 4 | 4 |
| | Properties | Slab hardness (Shore D) | 79 | 65 | 66 | 66 | 66 |
| | | Flexural modulus (MPa) | 1200 | 295 | 300 | 300 | 434 |
| | | Tensile modulus (MPa) | 1200 | 350 | 440 | 440 | 480 |
| | Intermediate layer thickness (mm) | | 1.0 | 1.0 | 1.0 | 1.0 | 1.0 |
| | Surface hardness Hm (Shore D) | | 81 | 65 | 68 | 68 | 68 |
| Cover | Cover composition No. | | X | X | Y | X | X |
| | Thickness (mm) | | 0.5 | 0.5 | 0.5 | 0.5 | 0.5 |
| | Cover slab hardness Hc (Shore D) | | 32 | 32 | 48 | 32 | 32 |
| | Molding method | | Comp. | Comp. | Comp. | Comp. | Comp. |
| Golf ball evaluation | Compression deformation amount (mm) | | 2.15 | 2.4 | 2.35 | 2.4 | 2.25 |
| | Flight distance on driver shot (m) | | NG | 246.5 | 249.5 | 246.5 | 247.0 |
| | Spin rate on driver shot (rpm) | | | 2590 | 2210 | 2580 | 2600 |
| | Spin rate on short iron shot (rpm) | | | 6540 | 6210 | 6560 | 6380 |
| | Shot feeling | | | E | F | G | F |
| | Durability | | | 105 | 95 | 130 | 105 |

Notes on Table 5 to 7

Formulation: parts by mass

NG: Golf ball was broken by only one shot.

SURLYN 8945: a sodium ion neutralized ethylene-methacrylic acid copolymer ionomer resin (flexural modulus: 254 MPa) available from E.I. du Pont de Nemours and Company.

HIMILAN AM7329: a zinc ion neutralized ethylene-methacrylic acid copolymer ionomer resin (flexural modulus: 236 MPa) available from Du Pont-Mitsui Polychemicals Co., Ltd.

LEMMALOY BX505 a polymer alloy (flexural modulus: 2,200 MPa) of a polyphenylene ether resin and nylon 6, manufactured by Mitsubishi Engineering-Plastics Company.

LEMMALOY C82HL: a polymer alloy (flexural modulus: 2,400 MPa) of a polyphenylene ether resin and nylon 66, manufactured by Mitsubishi Engineering-Plastics Company.

LOTADER AX8840: an ethylene-acrylic acid-glycidyl methacrylate copolymer (amount of monomer containing a polar functional group: 8 mass %) available from Tokyo Zairyo Co., Ltd.

Primalloy B1980N: a thermoplastic polyester elastomer available from Mitsubishi Chemical Corporation.

"Comp." in molding method: compression molding

Golf balls No. 1 to 8 are the cases that the intermediate layer is formed from the highly elastic intermediate layer composition that contains, as a resin component, (A) the highly elastic resin and (B) the ionomer resin in a ratio (A)/(B) that equals (20 mass % to 80 mass %)/(80 mass % to 20 mass %), and that the surface hardness Hm of the intermediate layer is equal to or larger than the surface hardness Hs of the core (Hm≧Hs) and the hardness Hc of the cover is 45 or less in Shore D hardness. It is obvious that these golf balls No. 1 to 8 have improved durability, and flight distance, while maintaining the spin rate on the shots with a short iron and the shot feeling, as compared to golf ball No. 9 that includes an intermediate layer formed from an intermediate layer composition consisting of an ionomer resin as a resin component. It is obvious that among them, golf balls No. 1 to 4, and 6 to 8 in which the highly elastic intermediate layer composition contains (C) the resin having a polar functional group have improved durability to a greater extent. It is noted that since golf ball No. 6 showed a slightly low durability because of the high cover hardness. Golf ball No. 7 is the case that the surface hardness Hm of the intermediate layer is equal to the surface hardness Hs of the core (Hm=Hs). If compared with Golf ball No. 4 using the same intermediate layer composition and the same cover composition as those of Golf ball No. 7, the effect of lowering the spin rate on the driver shot tended to be slightly small.

Golf ball No. 10 is the case that the intermediate layer is formed from the intermediate layer composition that consists of a thermoplastic polyester elastomer as a resin component. The durability was not at a practical level. Golf ball No. 11 and 12 are the case that the ratio ((A)/(B)) of (A) the highly elastic resin and (B) the ionomer resin in an intermediate layer composition is 90 parts by mass/10 parts by mass or 10 parts by mass/90 parts by mass. Golf ball No. 11 did not have the durability at a practical level, and Golf ball No. 12 showed an inferior flight distance.

Golf ball No. 13 is the case that the cover has a hardness Hc of more than 45 in Shore D hardness and was inferior with respect to the spin rate on the shots with short irons, shot feeling, and durability. Golf ball No. 14 is the case that the core is a single-layered core without the surrounding layer and was inferior with respect to the flight distance. Golf ball No. 15 is the case that the surface hardness Hm of the intermediate layer is smaller than the surface hardness Hs of the core (Hm<Hs), and was inferior with respect to the shot feeling. Further, if compared with Golf ball No. 3 using the same intermediate layer composition and the same cover composition as those of Golf ball No. 15, the effect of lowering the spin rate on the driver shot was small.

The present invention can be applied to the golf ball which requires a balance between the flight distance on the driver shots and the approach performance on the approach shots and the excellent shot feeling and durability. This application is based on Japanese Patent application No. 2008-264249 filed on Oct. 10, 2008, the contents of which are hereby incorporated by reference

The invention claimed is:

1. A golf ball comprising:

a core consisting of a center and a surrounding layer covering the center;

at least one intermediate layer covering the core; and a cover covering the intermediate layer;

wherein at least one piece or one layer of the intermediate layer is formed from a highly elastic intermediate layer composition that contains (A) a highly elastic resin having a flexural modulus in a range from 700 MPa to 5,000 MPa and (B) an ionomer resin having a flexural modulus in a range from 150 MPa to 1,000 MPa in a content ratio ((A)/(B)) of (A) the highly elastic resin to (B) the ionomer resin (B) being (20 mass % to 80 mass %)/(80 mass % to 20 mass %) (the total is 100 mass %), wherein a surface hardness Hm of the intermediate layer and a surface hardness Hs of the core satisfy an equation: Hm≧Hs, and the cover has a slab hardness Hc of 45 or less in Shore D hardness, and wherein the highly elastic resin (A) is at least one member selected from a group consisting of polybutylene terephthalate, a polymer alloy of polyphenylene ether and polyamide 6, and a polymer alloy of polyphenylene ether and polyamide 66.

2. The golf ball according to claim 1, wherein the surface hardness Hs of the core is ranging from 45 to 65 in Shore D hardness.

3. The golf ball according to claim 1, wherein regarding slab properties, the highly elastic intermediate layer composition has a hardness in a range from 65 to 75 in Shore D hardness, a flexural modulus in a range from 300 MPa to 1,000 MPa, and a tensile modulus in a range from 400 MPa to 1,500 MPa.

4. The golf ball according to claim 1, wherein the highly elastic intermediate layer composition further contains (C) a resin having a polar functional group in an amount from 0.1 part by mass to 30 parts by mass with respect to 100 parts by mass of a sum of (A) the highly elastic resin and (B) the ionomer resin.

5. The golf ball according to claim 1, wherein the cover has dimples in a total number ranging from 200 to 500.

6. The golf ball according to claim 1, wherein the cover has a thickness of 0.8 mm or less.

7. The golf ball according to claim 1, wherein a surrounding layer composition forming the surrounding layer has a slab hardness in a range from 40 to 65 in Shore D hardness.

8. The golf ball according to claim 1, wherein the core has a surface hardness Hs in a range from 45 to 65 in Shore D hardness, and the core has a center hardness Ho in a range from 20 to 60 in Shore D hardness, and a hardness difference (Hs-Ho) is ranging from 10 to 45.

9. The golf ball according to claim 1, wherein a hardness difference (Hm-Hs) between the surface hardness Hm of the intermediate layer and the surface hardness Hs of the core is ranging from 3 to 20 in Shore D hardness.

10. The golf ball according to claim 1, wherein the core has a compression deformation amount from 2.0 mm to 4.5 mm when applying a load from 98 N as an initial load to 1275N as a final load.

11. The golf ball according to claim 1, wherein the golf ball has a compression deformation amount from 2.0 mm to 3.0 mm when applying a load from 98 N as an initial load to 1275N as a final load.

12. The golf ball according to claim 1, wherein the core has a diameter from 32.0 mm to 41.5 mm.

13. The golf ball according to claim 1, wherein the intermediate layer has a thickness from 0.3 mm to 3.0 mm.

14. A four-piece golf ball, comprising a core consisting of a center and a surrounding layer covering the center;

an intermediate layer covering the core; and a cover covering the intermediate layer;

wherein the intermediate layer is formed from a highly elastic intermediate layer composition that contains (A) a highly elastic resin having a flexural modulus in a range from 700 MPa to 5,000 MPa and (B) an ionomer resin having a flexural modulus in a range from 150 MPa to 1,000 MPa in a content ratio ((A)/(B)) of (A) the highly elastic resin to (B) the ionomer resin (B) being (20 mass % to 80 mass %)/(80 mass % to 20 mass %) (the total is 100 mass %), wherein (A) the highly elastic resin is at least one member selected from a group consisting of polybutylene terephthalate, a polymer alloy of polyphenylene ether and polyamide 6, and a polymer alloy of polyphenylene ether and polyamide 66, and wherein a surface hardness Hm of the intermediate layer and a surface hardness Hs of the core satisfy an equation: Hm≧Hs, and the cover has a slab hardness Hc of 45 or less in Shore D hardness.

15. The golf ball according to claim 14, wherein the core has a surface hardness Hs in a range from 45 to 65 in Shore D hardness, and the core has a center hardness Ho in a range from 20 to 60 in Shore D hardness, and a hardness difference (Hs-Ho) is ranging from 10 to 45.

16. The golf ball according to claim 15, wherein the highly elastic intermediate layer composition further contains (C) a resin having a polar functional group in an amount from 0.1 part by mass to 30 parts by mass with respect to 100 parts by mass of a sum of (A) the highly elastic resin and (B) the ionomer resin.

17. The golf ball according to claim 16, wherein the cover comprises a polyurethane resin and has a thickness of 0.5 mm or less.

18. The golf ball according to claim 17, wherein the surrounding layer is formed from a surrounding layer composition containing a rubber composition as a main component and has a thickness from 3.0 mm to 17.0 mm, and the center has a diameter from 5.0 mm to 35.0 mm

19. The golf ball according to claim 17, wherein the surrounding layer is formed from a surrounding layer composition containing a resin composition as a main component and has a thickness from 0.2 mm to 3.0 mm, and the center has a diameter from 31.0 mm to 41.0 mm.

* * * * *